US009409101B1

(12) United States Patent
Carleo

(10) Patent No.: US 9,409,101 B1
(45) Date of Patent: Aug. 9, 2016

(54) MULTI-SENSORY MODULE ARRAY

(71) Applicant: Giancarlo A. Carleo, Dallas, TX (US)

(72) Inventor: Giancarlo A. Carleo, Dallas, TX (US)

( * ) Notice: Subject to any disclaimer, the term of this patent is extended or adjusted under 35 U.S.C. 154(b) by 0 days.

(21) Appl. No.: 14/819,416

(22) Filed: Aug. 5, 2015

Related U.S. Application Data

(63) Continuation-in-part of application No. 13/839,009, filed on Mar. 15, 2013, now Pat. No. 9,126,124.

(51) Int. Cl.
*A63J 5/04* (2006.01)
*A63G 31/00* (2006.01)
*A63J 21/00* (2006.01)

(52) U.S. Cl.
CPC .. *A63J 5/04* (2013.01); *A63G 31/00* (2013.01)

(58) Field of Classification Search
CPC ..... G03B 21/14; G03B 21/56; G03B 21/60; G02B 26/08; G02B 27/22; A63J 21/00; A63H 33/22; A63H 37/00
USPC ..... 472/57, 60–61, 75, 80, 64, 136; 359/444, 445, 451, 458, 459, 462
See application file for complete search history.

(56) References Cited

U.S. PATENT DOCUMENTS

| | | | |
|---|---|---|---|
| 2,369,340 | A | 2/1945 | Ditty et al. |
| 2,846,221 | A | 8/1958 | Skinner |
| 2,905,049 | A | 9/1959 | Laube |
| 4,512,117 | A | 4/1985 | Lange |
| 4,629,604 | A | 12/1986 | Spector |
| 4,640,266 | A | 2/1987 | Levy |
| 4,962,687 | A | 10/1990 | Belliveau et al. |
| 5,205,101 | A | 4/1993 | Swan et al. |
| 5,754,663 | A | 5/1998 | Goldfarb |
| 5,850,457 | A | 12/1998 | Gefvert |
| 6,169,595 | B1 | 1/2001 | Manne |
| 6,695,985 | B2 | 2/2004 | Igarashi et al. |
| 6,702,767 | B1 | 3/2004 | Douglas et al. |
| 6,865,023 | B2 | 3/2005 | Shafer |
| 7,746,002 | B2 | 6/2010 | Van Meurs et al. |
| 8,299,903 | B2 | 10/2012 | Haase et al. |
| 8,300,869 | B2 | 10/2012 | Marlin et al. |
| 8,363,865 | B1 | 1/2013 | Bottum |
| 9,126,124 | B2 | 9/2015 | Carleo |
| 2005/0024488 | A1 | 2/2005 | Borg |
| 2012/0250912 | A1 | 10/2012 | Chung |

*Primary Examiner* — Kien Nguyen
(74) *Attorney, Agent, or Firm* — Law Office of Sam Sokhansanj PLLC

(57) ABSTRACT

A multi-sensory module array system for enhancing the experience of members of the audience at entertainment events through the stimulation of a plurality of the senses of sight, sound, touch, taste and smell independent of their location or proximity to a live or recorded performance at one or more venues. In one aspect, the multi-sensory module array system includes a first zone having a first set of multi-sensory entertainment module spaced apart from each other and defining a first diamond configuration, wherein the modules are configured to emit one or more sensory outputs within the first zone. The system can further include a second zone having a second set of multi-sensory entertainment modules spaced apart from each other and defining a second diamond configuration and further configured to emit the sensory outputs within the second zone. Here, at least one of the modules can be shared between the first set and second set. In addition, the amplitude or magnitude of the sensory outputs within the first zone can be substantially the same with respect to the second zone.

18 Claims, 6 Drawing Sheets

MULTI-SENSORY MODULE ARRAY

CROSS-REFERENCE TO RELATED APPLICATION

This application is a continuation-in-part (CIP) of U.S. non-provisional application Ser. No. 13/839,009 filed on Mar. 15, 2013, which is herein incorporated by reference in its entirety.

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Conventional sound and light reproduction systems and many others like them are typically directed to solving problems related to transportability of a stage and/or the ability to direct light or sound from the stage towards the audience. Additionally, conventional systems are also focused on delivering a partial sensory experience to an individual in an enclosure. For example, U.S. Pat. No. 6,702,767 relates to a multisensory stimulation system wherein an individual is seated in a viewing chamber that provides stimulation through an optical system as well as aromatic sensory components, tactile sensation devices, an audio input system, and an audio delivery device. The focus of these conventional systems is generally providing an individual with a partial sensory stimulation experience for the purpose of stress relief. Other prior systems relate the distribution of fragrance throughout a building or a room, such as a theater, for the purpose of masking foul odors.

Conventional and prior systems lack enhancing the experience of the audience at entertainment venues through multisensory stimulation of the senses of sight, sound, taste, touch and smell. As such, the experience of an audience member in an entertainment venue who sits closer to the stage is generally quite different than the experience of an audience member who sits farther away from the stage. For example when fragrance intended to be incorporated into a performance, the audience members sitting closer to the stage are more likely to experience stimulation of their senses of smell when fragrance emitters are located near the stage. Similarly, when pyrotechnics are incorporated as part of a performance, those seated closer to the stage will have a better view of the pyrotechnics than those seated farther away from the stage. Additionally, those seated closer to the stage will generally receive greater stimulation of their senses of sound than those seated farther from the stage when the speakers or sound reproduction system is located at or near the stage. Additionally, when taste stimulation is emitted from the stage, those seated close to the stage are more likely to be stimulated than those seated away from the stage. Also, when touch is stimulated by, for example bubble or foam emission from the stage, those located near the stage are more likely to be stimulated.

Hence, what is needed is a multi-sensory module array system that allows audience members at a venue to experience the same or substantially the same multi-sense stimulation independent of their location or proximity to a live or recorded performance within the venue, outside the venue, or remotely, among others.

BRIEF SUMMARY

In one aspect of the disclosure described herein, a multi-sensory module array system, apparatus, and method are disclosed for enhancing the experience of members of the audience at entertainment events through the stimulation of a plurality of the senses of sight, sound, touch, taste and smell independent of their location or proximity to a live or recorded performance. In particular, the multi-sensory module array system may be incorporated in venues such as amphitheaters, concert halls, auditoriums, indoor and outdoor public presentation venues, convention centers, drive-in theaters and the like. Here, one object of the disclosed described herein is to enhance the stimulation of the audience at an entertainment venue so that, regardless of where an attendee is seated within a venue, his/her sensory experience will closely approximate the sensory experience of every other attendee.

In another aspect of the disclosure described herein, a multi-sensory module array system is provided having a first zone with a first, second, third, and fourth multi-sensory entertainment module spaced apart from each other and defining a first perimeter configuration, wherein the first, second, third, and fourth modules are configured to emit a sensory output within the first zone. The system can further include a second zone having the fourth, a fifth, a sixth, and a seventh multi-sensory entertainment modules spaced apart from each other and defining a second perimeter configuration of the fourth, fifth, sixth, and seventh modules, wherein the fourth, fifth, sixth, and seventh modules are configured to emit the sensory output within the second zone. Here, the fourth module is shared between the first zone and second zone. In addition, the first zone and second zone spatial area dimensions are nearly identical with respect to each other. Further, the first and second configurations of the first, second, third, fourth, fifth, sixth, and seventh modules are configured above or around one or more audience members in a horizontal plane, and wherein the amplitude of the sensory output within the first zone is nearly identical with respect to the second zone.

Further, the fourth module shares one channel with the first zone and a second channel with the second zone. In addition, the multi-sensory modules are further coupled to a lattice grid structure. The first and second perimeter configurations are further comprised of a diamond configuration. In addition, the sensory output of the multi-sensory modules are comprised of one or more of: sound, sight, touch, smell, and taste. The multi-sensory module can further be comprised of two or more of: speaker or audio emitting module, heating or cooling element emitting module, display or video emitting module, fragrance emitting module, fog or vapor emitting module, pyrotechnic emitting module, light emitting module, laser emitting module, CO2 emitting module, camera or image capturing module, microphone or sound capturing module, liquid dispensing module, and tesla coils. In addition, the first and second zones are at a first location, and third and fourth zone having a plurality of multi-sensory modules at a second location, wherein the amplitude of the sensory outputs at the first location are nearly identical to the second location. Further, the plurality of multi-sensory modules at the second location can communicate via a network with the multi-sensory modules at the first location. Also, the system can include a live performance location or stage having one or more devices for capturing one or more senses from the live performance location and transmitting the senses to the multi-sensory modules of the first and second zones.

In another aspect of the disclosure described herein, a multi-sensory module array system is provided having a first zone comprised of a first, second, third, and fourth multi-sensory entertainment modules spaced apart from each other and defining a first configuration, wherein the first, second, third, and fourth modules are configured to emit a sensory output within the first zone. The second zone can further include the third, the fourth, a fifth, and a sixth multi-sensory entertainment modules spaced apart from each other and defining a second configuration of the third, fourth, fifth, and modules, wherein the third, fourth, fifth, and sixth modules are configured to emit the sensory output within the second zone. In addition, the third and fourth modules are shared between the first and second perimeter configuration, the first zone and second zone spatial area dimensions are substantially the same with respect to each other. Further, the first and second configurations of the first, second, third, fourth, fifth, and sixth modules are configured above or around one or more attendees in a horizontal plane, and wherein the amplitude of the sensory output within the first zone is substantially the same or deviating at most 10% with respect to the second zone.

In another aspect of the disclosure described herein, the experience of an audience member in an entertainment venue who is near or closer to a performance stage is substantially the same experience of an audience member who may sit farther away from the stage. For example when fragrance and smell is intended to be incorporated into a performance, the audience members situated, standing, or sitting far away from the performance stage will experience the same or substantially the same fragrances and smell as the audience members situated close to the stage. Similarly, when pyrotechnics are incorporated as part of a performance, those seated far away (or at a remote location) will experience substantially the same pyrotechnics as those seated near the stage. Additionally, when taste stimulation is emitted from the stage, those seated away or at a substantial distance from the stage will experience the same taste stimulation as those seated near or very close to the stage. Also, when touch via foam or bubble emission, members positioned in an area or zone far away from the stage will experience the near identical experience as those close or on the performance stage. In addition, attendees or audience members may also experience the same five senses or one or more the five senses as experienced by the performers who are performing live on the stage, such as DJs, musicians, bands, orchestras, comedians, plays, actors, and the like.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

In the Brief Summary of the present disclosure above and in the Detailed Description of the Disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Phrases and terms similar to "software", "application", and "firmware" may include any non-transitory computer readable medium storing thereon a program or algorithm, which when executed by a computer, causes the computer to perform a method, process, or function.

Phrases and terms similar "network" may include one or more data links that enable the transport of electronic data between computer systems and/or modules. When information is transferred or provided over a network or another communications connection (either hardwired, wireless, or a combination of hardwired or wireless) to a computer, the computer uses that connection as a computer-readable medium. Thus, by way of example, and not limitation, computer-readable media can also comprise a network or data links which can be used to carry or store desired program code means in the form of computer-executable instructions or data structures and which can be accessed by a general purpose or special purpose computer.

Figure 1A:
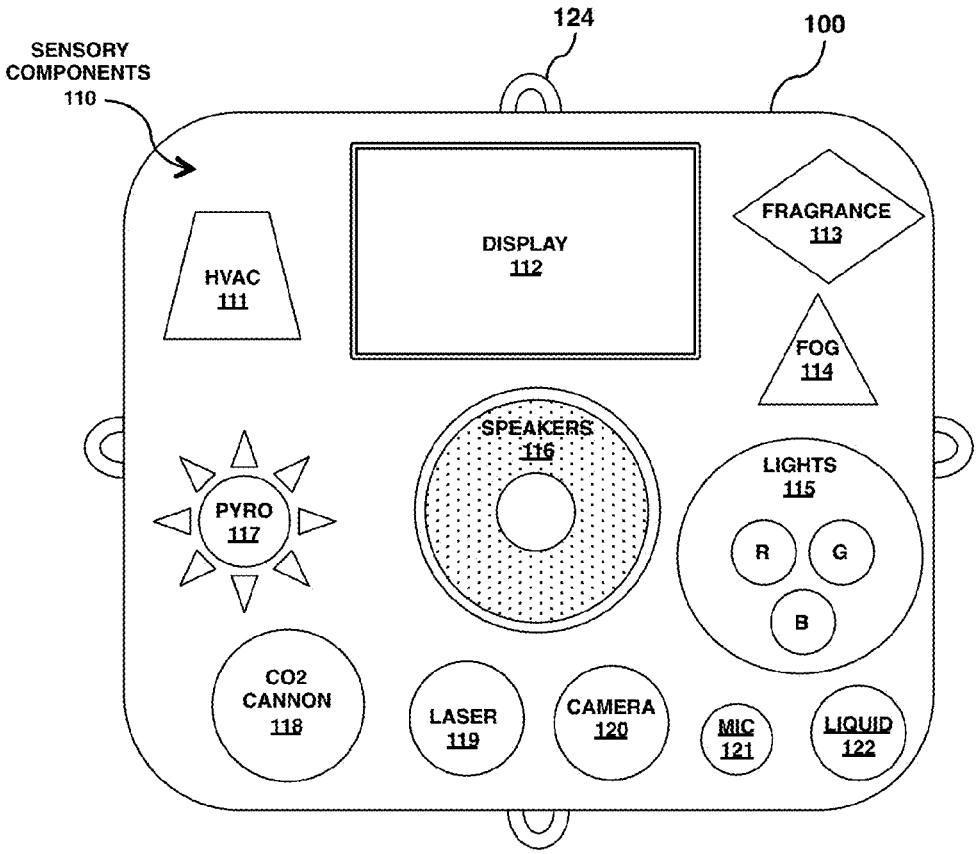
FIG. 1A illustrates a side view for one non-limiting embodiment of a multi-sensory module of the disclosure described herein.

FIG. 1A illustrates one embodiment for a multi-sensory module of the disclosure described herein. In particular, multi-sensory module 100 can include a plurality of output sensory emitting, generating, transmitting, dispensing, producing, and generation components 110 including but not limited to powered HVAC 111 modules and output ports having heating, cooling, air conditioning, heat exchanging, air flow, air quality, and humidity control capabilities; screen, image/video output, monitor, or display ports or modules 112 having graphics, image, and video output and generation capabilities; olfactory or fragrance output ports or modules 113 having olfactory, smell, scent, and odor generation and output capabilities; fog output modules or ports 114 having fog, haze, cloud, or air moisture generation capabilities; lighting output ports or modules 114 having white, warm, soft, or colored light generation capabilities such as LED, incandescent, fluorescent, HID lamps, light augmentation lenses, and tesla coil lightning effect; audio amplification and speakers ports or modules 116 for generating, amplifying, modulating, filtering, and outputting sound and audio, wherein the speakers may also include a plurality of independent output channels and speaker orientations; pyrotechnic ports or modules 117 for generating and outputting pyrotechnic capabilities such as fire, flames, sparks, and the like; CO2 cannon ports and modules 118 for generating and outputting CO2 and fog; laser output ports or modules 119 for generating laser beam outputs such as colored semiconductor lasers; and camera 120 for image and video capture, scanning, and tracking capabilities, including infrared cameras and object tracking capabilities; and microphone ports or modules 121 for audio and sound capturing capabilities; and liquid module or ports 122 for dispensing or spraying any type of liquid such as water, foam, bubbles, paint, or any natural, flavored, or chemical liquid based composition. In addition, module 100 may also include a plurality of attachment points 124 for coupling to a frame, grid, lattice structure, or stand-alone supports, wherein modules 100 can each have their own independent support or stand or suspension member. It is contemplated within the scope of the disclosure herein that module 100 may also include storage compartment and mixing capabilities for receiving source materials, fluids, scents, compositions, and power for delivering, transmitting, and emitting sensory outputs via components 110.

Figure 1B:
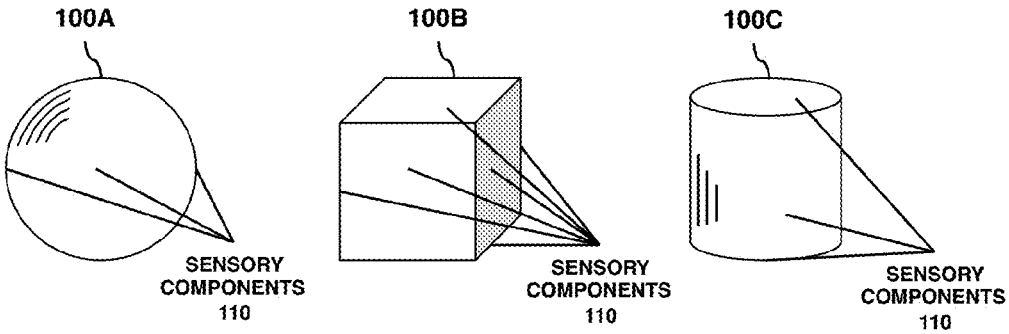
FIG. 1B illustrates perspective views for one or more non-limiting embodiments of the multi-sensory modules of the disclosure described herein.

FIG. 1B illustrates one or more embodiments of multi-sensory module of the disclosure described herein. In particular, each of modules 100A, 100B, and 100C can have sensory components 110, or specifically 111-122, one or more surfaces, side, exterior, or interior for each configuration of modules 100A, 100B, and 100C. For example, in one embodiment, cubic module 1008 may have output ports for any one or more of components 111-122 on all six sides, or alternatively on one or more sides. Similarly, spherical configuration module 1008 may have any number of components 111-122 on any one or more of its exterior or interior portions. It is contemplated within the scope of the disclosure described herein that any of sensory components 111-122 may communicate bi-directionally with each other, either wired or wirelessly. In addition, module 100 can also include one or more controllers, memory/RAM, network and communication modules, programs, firmware, software, applications, algorithms, and microprocessors for manually or automatically control or operate programmable components 111-122 depending on the desired output and magnitude for each component 111-122. For example, in one embodiment, HVAC module 110 may be operated simultaneously with light module 115 and fragrance module 113. Alternatively, any of sensory components 111-122 may be programmed, operated, linked, correlated, and synced to activate or deactivate with respect to video or audio properties such as notes, amplitude, frequencies, beat, speed, peaks, troughs, rhythm, bass, treble, pitch, images, word, artist, lyrics, and tone of one or more songs or performances, wherein the magnitude, output, and timing of each sensory component 111-122 at a module 100 may also be independently controlled. For example, a programmable module 100 may be programmed or controlled to sync to threshold or predetermined audio data properties of a song or song clip being performed by a performer, wherein the song can generate all five senses (or one or more senses) to be emitted by the module at specific times and for specific periods during the duration the song is being played by the performer. More specifically, one song may generate different sensory experiences via the modules compared to a second song. Here, the modules may have programmable software for detecting certain audio data properties (i.e. note, frequency, lyric, beat) within the first or second songs and thereby automatically trigger emitting sensory outputs via the one or more sensory components 110 for specific or predefined times and durations that depend on the audio data properties of the song.

Referring to FIG. 1A, in another embodiment, camera 120 and microphone 121 modules may capture sound, video, and tracking data of an audience crowd within one or more zones in real-time and in response the multi-sensory module controller (or operator) automatically adjusting activation, deactivation, or magnitude of any of the one or more sensory components 111-122. However, it is contemplated within the scope of the disclosure described herein that any number and combinations for a method of operation, programming, output magnitude, and timing for each of components 111-122 depending on the desired or intended setting, building, structure, area to be covered, audience, spatial dimensions, computing, power, and network capabilities, music, song, and performance, among others.

Figure 2:
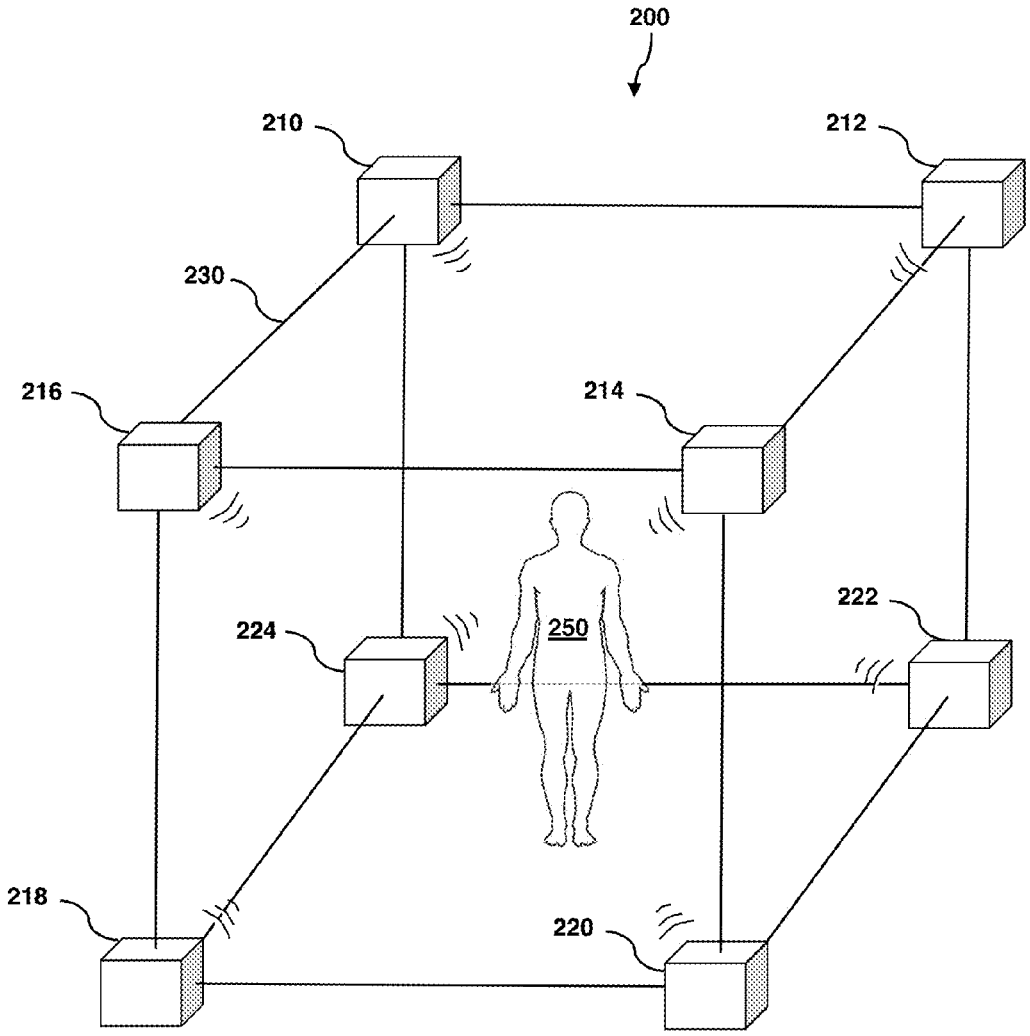
FIG. 2 illustrates a perspective view for one non-limiting embodiment for an array configuration of the multi-sensory modules of the disclosure described herein.

FIG. 2 illustrates one embodiment for a lattice array configuration with the multi-sensory modules of the disclosure described herein. Here, configuration 200 can include a plurality of modules 210-224 connected via one or more network analog or digital cables 230 and positioned above, around, or below (such as ground level) of one or more audience members 250 within a spatial zone. However, it is contemplated within the scope of the disclosure described herein that any of modules 210-224 may also be connected wirelessly and be powered independently via wireless or connected power, batteries, solar energy, wind energy, or hydro energy, among others. Further, any one or more of modules 210-224 may each have the same output components (FIG. 1A) or each having a different set of output components. In addition, any one or more of modules 210-224 (or its face and channels) may be oriented in any direction to achieve optimal output within the spatial zone it is covering. Further, each of modules 210-224 may also be spaced equally apart from each other, wherein their magnitude outputs are also equal to each other for the particular spatial zone. Alternatively, any one or more of modules 210-224 may also be spaced apart from each other at varying, alternating, or asymmetrical distances, depending on the magnitude, audience, spatial area, and spatial zone intended to be covered by the modules. In addition, any one or more of modules 210-224 may communicate bi-directionally with each other or with any one or more of local or remote computing systems.

Figure 3:
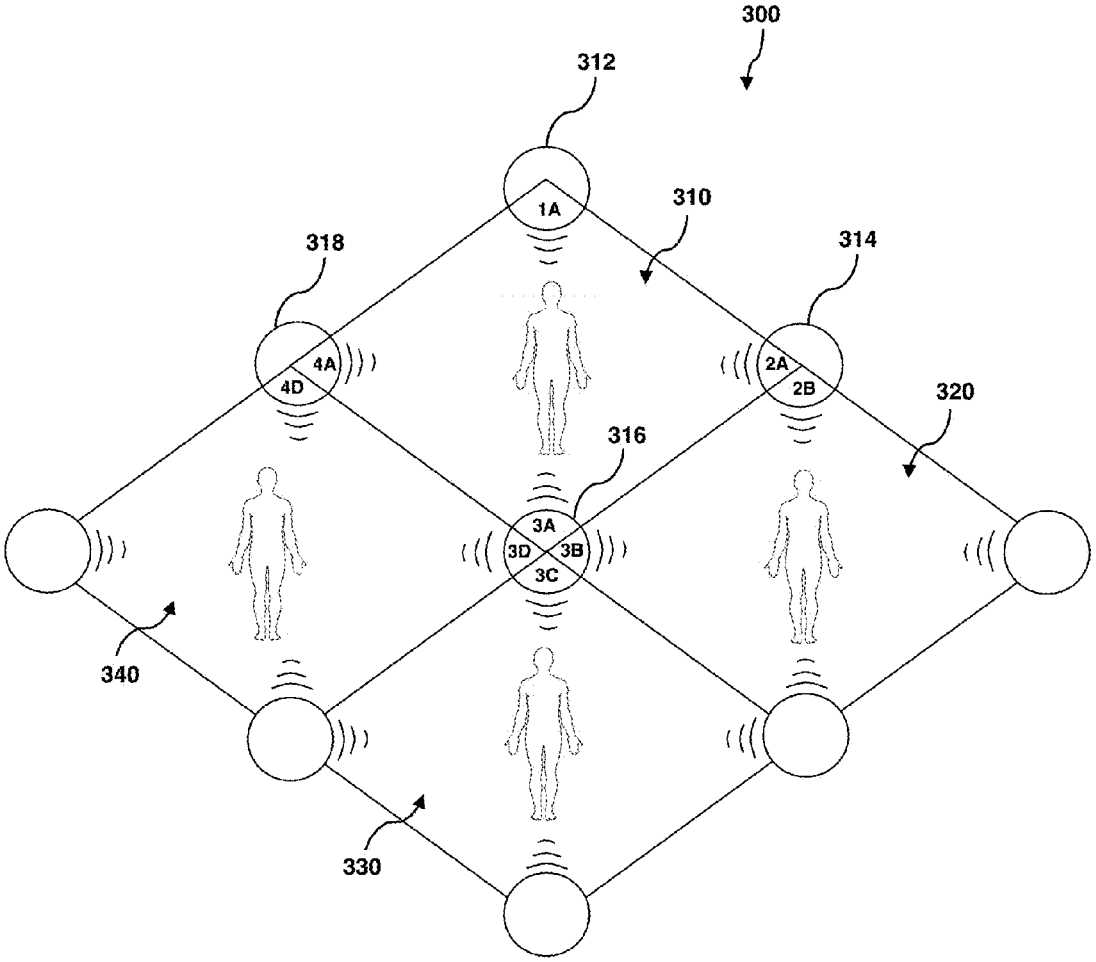
FIG. 3 illustrates a top view for another non-limiting embodiment for an array configuration of the multi-sensory modules of the disclosure described herein.

FIG. 3 illustrates one embodiment for a diamond shape lattice grid configuration for the multi-sensory modules of the disclosure described herein. Here, lattice grid configuration 300 can include zones 310, 320, 330, and 340 and a plurality of modules configured for each zone or alternatively one or more modules shared between one or more zones. In particular, in one embodiment, multi-sensory modules 312, 314, 316, and 318 can each have separate independent channels wherein each channel is configured to output the one or more sensory components (FIG. 1A) to a pre-determined or designated zone 310, 320, 330, and 340. More specifically, module 312 can share channel 1A for zone 310, module 314 can share channels 2A with zone 310 and channel 2B with zone 320, module 316 can share channel 3A with zone 310, channel 3B with zone 320, channel 3C with zone 330, and channel 3D with zone 340, and module 318 can share channel 4A with zone 310 and channel 4D with zone 340. Here, channels may also be individual or combination of sensory components.

Figure 4:
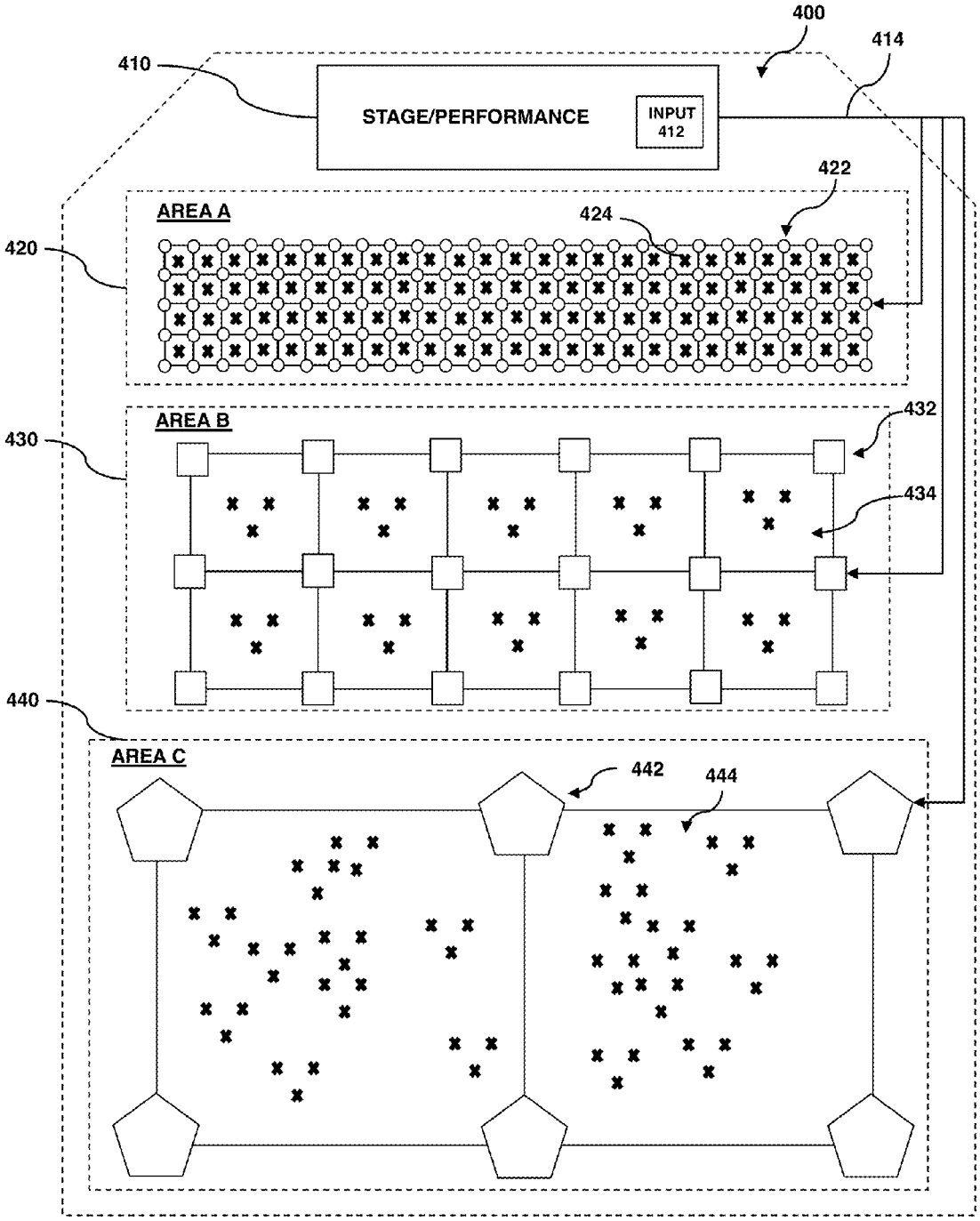
FIG. 4 illustrates a top view for another non-limiting embodiment for an array structure configuration having multiple independent areas for the multi-sensory modules of the disclosure described herein.

FIG. 4 illustrates another embodiment for a lattice grid configuration of the multi-sensory modules of the disclosure described herein. Here, an entertainment venue 400 can include a performance stage 410 and several independent zones, tiers, seating, groups, or open or closed off areas 420, 430, and 440. Here, each area may also have its own predefined multi-sensory module grid structure for each audience member(s) in a sub-zone. For example, in one embodiment, area 420 may be a higher or more expensive ticket priced zone, wherein audience members (or sub-zones) 424 demand a higher quality or more personable sensory output from the multi-sensory module grid 422. Here, each audience member "x" may have his or her own sub-zone spatial space 424 to achieve the most optimal multi-sensory experience from the one or more sensory components (FIG. 1A) of the multi-sensory modules. In addition, a separate area 430 may have a slightly larger size multi-sensory module grid structure 432 having spatial area sub-zones 434 to cover and accommodate a plurality of audience members "x" within each sub-zone 434, such as audience members who purchased medium-grade quality tickets. Here, in order for modules 432 to accommodate a much larger spatial sub-zone area, as compared to sub-zone 424, modules 432 can be a different set of higher-powered modules with respect to modules 422. Alternatively, the magnitude output for each of modules 432 can be configured to have much larger amplitudes than modules 422. Further, a separate area 440 may be designated for general admission (least expensive) ticket holders, wherein modules 442 are configured to cover and accommodate audience members "x" dispersed within each sub-zone spatial area 444. Here, in order for modules 442 to accommodate a much larger spatial sub-zone area 444, as compared to sub-zone 434, modules 442 can be a different set of higher-powered modules with respect to modules 432. Alternatively, the magnitude output for each of modules 432 can be configured to have much larger amplitudes than modules 422.

Still referring to FIG. 4, it is contemplated within the scope of the disclosure described herein that any of stage 410, areas 420, 430, and 440 may be entirely isolated from each other, linked, or associated with each other. For example, in other embodiments, modules 422 may be directly linked to modules 432 and modules 432 directly linked to modules 444. Here, sound, smell, taste, sight, and touch input devices, computing, networked, and capturing systems 412 from performance stage 410 can be broadcasted via a wired or wireless network 414 in real-time to be outputted via the sensory components of the any one or more of modules 422, 432, and 444 to their designated sub-zones, wherein the magnitude and amplitude of the sensory components for each module is automatically, manually, or programmably controlled.

Figure 5:
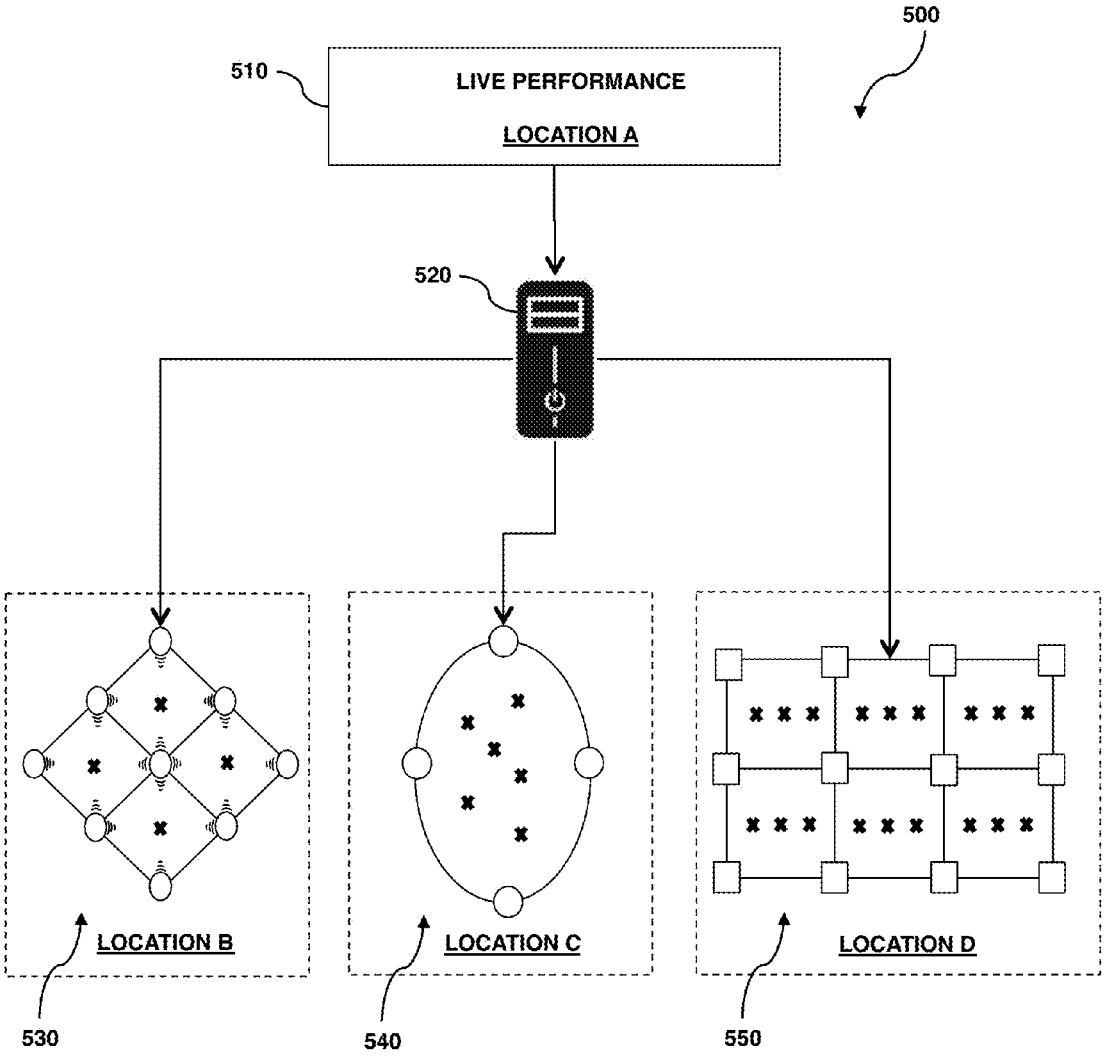
FIG. 5 illustrates a block diagram for another non-limiting embodiment for a networked array structure configuration having multiple remote locations for the multi-sensory modules of the disclosure described herein.

FIG. 5 illustrates another embodiment for a networked architecture for linked lattice grid structures of multi-sensory modules at separate locations. Here, network configuration 500 can include a live performance location 510 having sensory input capturing devices for transmitting via a networked central computing system 520 to a plurality of remote locations 530, 540, and 550, each having their own respective multi-sensory module configurations and sub-zone spatial areas independent from the other locations. For example, each location 530, 540, and 550 may either be several feet, miles, cities, states, or countries apart. In addition, the modules with each location may be configured specifically for their respective sub-zones. For example, location 540 may be on water, such as a lake, pond, or ocean, wherein each of the linked modules for location 540 are configured to only cover and emit the sensory outputs and components to its respective zone or sub-zone having one or more audience members, boats, floating objects, or dwellings, among others.

Figure 6A:
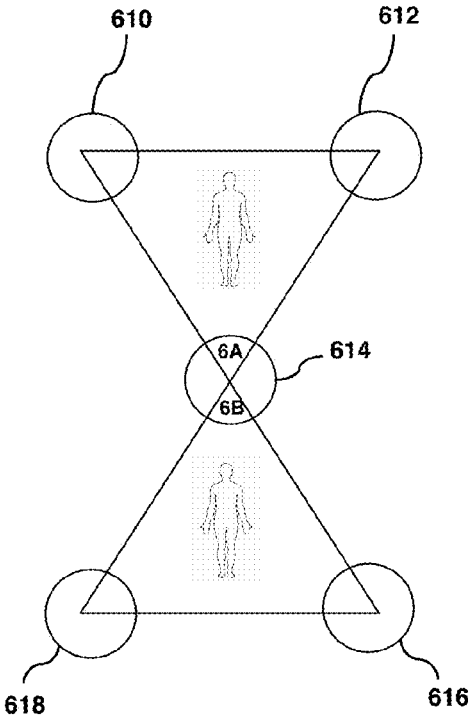
FIG. 6A illustrates a top view for another non-limiting embodiment for an array configuration of the multi-sensory modules of the disclosure described herein.
Figure 6B:
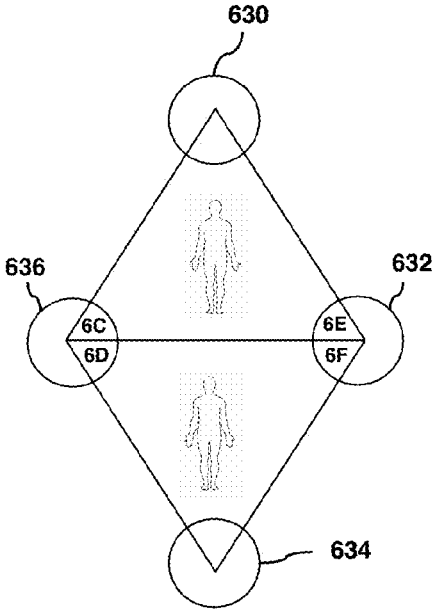
FIG. 6B illustrates a top view for another non-limiting embodiment for an array configuration of the multi-sensory modules of the disclosure described herein.

FIG. 6A illustrates another embodiment for a diamond or triangular configuration of the multi-sensory modules. Here, modules 610, 612, and 614 can cover a first zone and modules 614, 616, and 618 covering a second zone, wherein module 614 can be shared between the two zones. In particular, module 614 may have sub-divided dual channels 6A for the first zone and a channel 6B for the second zone. FIG. 6B illustrates another embodiment for a diamond or triangular configuration of the multi-sensory modules. Here, modules 630, 632, and 636 can cover a first zone and modules 632, 634, and 636 covering a second zone, wherein modules 632 and 634 are shared between the first and second zones. In particular, module 636 may have a channel 6C directed at the first zone and a channel 6D directed at the second zone. Similarly, module 632 may have a channel 6E directed at the first zone and channel 6F directed at the second zone.

In another embodiment of the disclosure described herein, a multi-sensory module structure is disclosed wherein the structure can extend throughout an entertainment venue, which may or may not originate from ground level and extend above the audience. The structure may form a lattice around the audience or be arranged in a diamond shape configuration. Furthermore, the lattice grid includes a plurality of multisensory entertainment modules suspended to, attached to, configured to, or represented by it, wherein the modules provide a plurality of senses to the audience. Here, each multisensory entertainment module may include one or more speakers, lights, lasers, fog generators, foam generators, fragrance diffusers, taste diffusers, pyrotechnic devices or fireworks. The multisensory entertainment module may also include other sensory stimulating devices, such as tactile, mental, psychological, and emotion altering, modifying, improving, reducing, and generating devices, systems, and methods. The various sensory stimulating devices incorporated in each multisensory entertainment module are housed such that they may be attached and detached from the module so that a plurality of sensory stimulating devices may be included in the module in any combination. Accordingly, a speaker may be combined with any or all of a light source, fog generator, foam generator, fragrance diffuser, taste diffuser, pyrotechnic device, heater or air conditioner.

The speaker incorporated in the multisensory entertainment module may be any wired or wireless electroacoustic transducer that produces sound in response to an electrical audio signal input. The light source incorporated in the multisensory entertainment module may be a stroboscopic lamp, an LED lamp, floodlight, laser light source or any other source of high intensity artificial light. The laser light source incorporated in the multisensory entertainment module may be any light source capable of projecting a laser beam or a holographic laser display. The taste diffuser incorporated into the multisensory entertainment module may be any device capable of emanating an aerosol spray, smoke, or vapor for stimulating the sense of taste. The fragrance diffuser incorporated into the multisensory entertainment module may be any device capable of emanating in aerosol spray capable of stimulating the sense of smell. The pyrotechnic device incorporate it in the multisensory entertainment module may be any device capable of producing self-contained and self-sustained exothermic reactions, including fireworks. The HVAC heating device incorporated in the multisensory entertainment module may include a gas powered heater, an electric powered heater, a solar powered heater, or any other device capable of producing the sensation of heat the members of the audience. The HVAC cooling or air-conditioning device incorporated in the multisensory entertainment module may include a gas powered air conditioner, and electric air conditioner, a solar powered air conditioner or any device capable of creating the sensation of cooling in the members of the audience.

In one embodiment, the multisensory entertainment modules are attached to the lattice grid structure or supported via stand-alone supports not connected to other supports, so that each member of the audience is located within a maximum optimal distance from a multisensory entertainment module (Γ). In this embodiment, each member of the audience in the entertainment venue receives sensory stimulation of similar quality to every other member of the audience. The maximum optimal distance from a multisensory entertainment module (Γ) permitted in this embodiment of the disclosure described herein can be calculated with the following equation: $\Gamma=\sqrt{\frac{1}{4}(b^2+a^2)}$ wherein "a" is the distance between consecutive multisensory entertainment modules along the y-axis and "b" is the distance between consecutive multisensory entertainment modules along the x-axis. In this embodiment of the disclosure described herein, no member of the audience will experience the performance from a distance greater than the maximum optimal distance from a multisensory entertainment module (Γ). This permits each member of the audience to receive stimulation from the speakers, light sources, fog generators, foam generators, fragrance diffusers, taste diffusers, pyrotechnic devices, and heaters or air conditioners incorporated in one or more of the multisensory entertainment modules. This enhances the sensory experience of each member of the audience so that the audience members seated farther away from the stage experience sensory stimulation of similar quality to the audience members seated closer to the stage.

In another embodiment of the disclosure described herein, the multisensory entertainment modules are configured as a lattice grid or diamond shaped array so as to evenly distribute sound pressure to the members of the audience. In this embodiment, each member of the audience experiences similar stimulation of his/her sense of sound. In this embodiment, the multisensory entertainment modules are distributed along the structure so that each member of the audience is exposed to sound pressure within 5 dB or up to 10 dB of the average sound pressure emitted by the multisensory entertainment modules. For example, if the average sound pressure emitted by the multisensory entertainment modules is 85 dB, the individual members of the audience are exposed to sound pressure in an amount at least equal to 80 dB and at most 90 dB. In addition, it is contemplated within the scope of the disclosure described herein that the magnitude or amplitude of modules or set of modules between one or more zones, sub-zones, areas, and locations may be the same, nearly identical, substantially the same, or at most having a magnitude or amplitude drop deviation of at most 25%, such as a 5% output magnitude tolerance or deviation from a first zone with respect to a second zone.

The foregoing descriptions of specific embodiments of the disclosure described herein have been presented for purposes of illustration and description. They are not intended to be exhaustive or to limit the disclosure described herein to the precise forms disclosed, and various modifications and variations are possible in light of the above teaching. The embodiments were chosen and described in order to explain the principles of the disclosure described herein and its practical application, to thereby enable others skilled in the art to utilize the disclosure described herein and various embodiments with various modifications as are suited to the particular use contemplated. It is intended that the scope of the disclosure described herein be defined by the claims appended hereto and their equivalents.

What is claimed is:

1. A multi-sensory module array system comprising:

a first zone comprised of a first, second, third, and fourth multi-sensory entertainment module spaced apart from each other and defining a first perimeter configuration, wherein the first, second, third, and fourth modules are configured to emit a sensory output within the first zone;

a second zone comprised of the third, the fourth, a fifth, and a sixth multi-sensory entertainment module spaced apart from each other and defining a second perimeter configuration of the third, fourth, fifth, and sixth modules, wherein the third, fourth, fifth, and sixth modules are configured to emit the sensory output within the second zone;

wherein the fourth module is shared between the first zone and second zone;

wherein the first zone and second zone spatial area dimensions are nearly identical with respect to each other; and wherein the first and second configurations of the first, second, third, fourth, fifth, and sixth modules are configured above or around one or more audience members, and wherein the amplitude of the sensory output within the first zone is nearly identical with respect to the second zone.

2. The system of claim 1, wherein the fourth module shares one channel with the first zone and a second channel with the second zone.

3. The system of claim 1, wherein the multi-sensory modules are further coupled to a lattice grid structure.

4. The system of claim 1, wherein the first and second perimeter configurations are further comprised of a diamond configuration.

5. The system of claim 1, wherein the sensory output of the multi-sensory modules is comprised of one or more of: sound, sight, touch, smell, and taste.

6. The system of claim 1, wherein the multi-sensory modules are further comprised of two or more of: speaker or audio emitting module, heating or cooling element emitting module, display or video emitting module, fragrance emitting module, fog or vapor emitting module, pyrotechnic emitting module, light emitting module, laser emitting module, CO2 emitting module, camera or image capturing module, microphone or sound capturing module, and liquid dispensing module.

7. The system of claim 1, further comprising wherein the first and second zones are at a first location, and a third and a fourth zone having a plurality of multi-sensory modules at a second location, wherein the amplitude of the sensory outputs at the first location are nearly identical to the second location.

8. The system of claim 7, wherein the plurality of multi-sensory modules at the second location communicate via a network with the multi-sensory modules at the first location.

9. The system of claim 1, further comprising a live performance location having one or more devices for capturing one or more senses from the live performance location and transmitting the senses to the multi-sensory modules of the first and second zones.

10. A multi-sensory module array system comprising:

a first zone comprised of a first, second, third, and fourth multi-sensory entertainment module spaced apart from each other and defining a first configuration, wherein the first, second, third, and fourth modules are configured to emit a sensory output within the first zone;

a second zone comprised of the third, the fourth, a fifth, and a sixth multi-sensory entertainment module spaced apart from each other and defining a second configuration of the third, fourth, fifth, and sixth module, wherein the third, fourth, fifth, and sixth modules are configured to emit the sensory output within the second zone;

wherein the third and fourth modules are shared between the first and second configurations;

wherein the first zone and second zone spatial area dimensions are substantially the same with respect to each other; and wherein the first and second configurations of the first, second, third, fourth, fifth, and sixth modules are configured above or around one or more attendees, and wherein the amplitude of the sensory output within the first zone is substantially the same with respect to the second zone.

11. The system of claim 10, wherein the multi-sensory modules are further coupled to a lattice grid structure.

12. The system of claim 10, wherein the first and second configurations are further comprised of a diamond configuration.

13. The system of claim 10, wherein the sensory output of the multi-sensory modules is comprised of one or more of: sound, sight, touch, smell, and taste.

14. The system of claim 10, wherein the multi-sensory modules are further comprised of two or more of: speaker or audio emitting module, heating or cooling element emitting module, display or video emitting module, fragrance emitting module, fog or vapor emitting module, pyrotechnic emitting module, light emitting module, laser emitting module, CO2 emitting module, camera or image capturing module, microphone or sound capturing module, and liquid dispensing module.

15. The system of claim 10, wherein the first and second zones are at a first location, and a third and a fourth zone having a plurality of multi-sensory modules at a second location, wherein the amplitude of the sensory outputs at the first location are nearly identical to the second location.

16. The system of claim 15, wherein the plurality of multi-sensory modules at the second location communicate via a network with the multi-sensory modules at the first location.

17. The system of claim 15, further comprising a live performance location having one or more devices for capturing one or more senses from the live performance location and transmitting the senses to the multi-sensory modules of the first and second location.

18. A multi-sensory module array system comprising:

a first zone comprised of a first, second, and third multi-sensory entertainment module spaced apart from each other and defining a first configuration, wherein the first, second, and third modules are configured to emit a sensory output within the first zone;

a second zone comprised of the third, a fourth, and a fifth multi-sensory entertainment module spaced apart from each other and defining a second configuration of the third, fourth, and fifth module, wherein the third, fourth, and fifth modules are configured to emit the sensory output within the second zone;

wherein the third module is shared between the first and second configurations;

wherein the first zone and second zone spatial areas are substantially the same with respect to each other; and wherein the first and second configurations are configured above or around one or more attendees, and wherein the amplitude of the sensory output within the first zone is substantially the same with respect to the second zone.

* * * * *